US005172899A

United States Patent [19]

Tajima

[11] Patent Number: 5,172,899

[45] Date of Patent: Dec. 22, 1992

[54] PAPER FEEDER

[75] Inventor: Akio Tajima, Tokyo, Japan

[73] Assignee: Seikosha Co., Ltd., Tokyo, Japan

[21] Appl. No.: 711,477

[22] Filed: Jun. 6, 1991

Related U.S. Application Data

[62] Division of Ser. No. 509,101, Apr. 13, 1990, Pat. No. 5,050,854.

[30] Foreign Application Priority Data

Apr. 28, 1989 [JP] Japan ..... 1-110114
Jun. 9, 1989 [JP] Japan ..... 1-146972

[51] Int. Cl.[5] ..... B65H 3/52
[52] U.S. Cl. ..... 271/122; 271/125
[58] Field of Search ..... 271/122, 125

[56] References Cited

U.S. PATENT DOCUMENTS 4,613,127 9/1986 Wishart ..... 271/122 X
4,801,134 1/1989 Yokoyama ..... 271/122
5,006,903 4/1991 Steurns ..... 271/122 X

*Primary Examiner*—Richard A. Schacher
*Attorney, Agent, or Firm*—Jordan and Hamburg

[57] ABSTRACT

A paper feeder includes a rotatable feed roller and a retard roller biasingly urged toward one another, the feed roller being rotatable in a feed direction for feeding a paper sheet between the feed roller and the retard roller. A pivot arm pivotably supports the retard roller, and a motor mounted on the pivot arm is operable to apply a turning torque to the retard roller in a direction opposite to the direction of feed of the feed roller.

1 Claim, 14 Drawing Sheets

PAPER FEEDER

This is a division of application Ser. No. 07/509,101, filed Apr. 13, 1990 now U.S. Pat. No. 5,050,854.

BACKGROUND OF THE INVENTION

This invention relates to a paper feeder used in printers and the like.

Paper feeders hitherto known are configured such that sheets stored in a sheet-feeding cassette in a piled state are taken out by a pickup roller one at a time, sent to a feed roller, and conveyed to a printing position. However, since the sheets are piled on each other, there exists the possibility of two or more sheets being taken out by the pickup roller. In view of such circumstances, a mechanism has been proposed to reliably convey only one sheet through a feed roller, the feed roller being held in resilient contact with a retard roller such that a second and further sheets are backed by the retard roller (see, for example, U.S. Pat. No. 4,368,881).

According to the foregoing prior art, the driving power for driving a retard roller is provided by the driving motor for driving a sensitizing drum of the printer; thus, a large number of parts, such as electromagnetic clutch and gear train, are required to transfer the turning force from the driving motor to the retard roller. Further, the retard roller must be brought into resilient contact with a feed roller with a given pressure to convey only one sheet. Therefore, the structure is complicated and the costs are high.

SUMMARY OF THE INVENTION

Therefore, it is an object of the present invention to convey only one sheet reliably, reduce the number of parts, simplify the structure, and attain cost reduction. Another object is to rotate a retard roller with a given turning torque and at a given rotational speed with ease.

A further object of the present invention is to provide a paper feeder of simplified structure in which a retard roller can be brought in resilient contact with a feed roller with a given pressure, thereby reliably conveying only one sheet.

To accomplish the foregoing objects, according to one embodiment of the present invention, a paper feeder comprises a pickup roller for taking out the uppermost sheet stored in a sheet-feeding cassette, a feed roller positioned on the downstream side of the pickup roller, a retard roller held in resilient contact with the feed roller, and a driving motor for rotating the retard roller in the opposite direction to the direction of rotation of the feed roller. The driving motor is secured to a retard plate integral with a rockably supported arm, and the turning torque exerted by the driving motor on the retard roller is set smaller than the product of the coefficient of friction between one sheet being fed and the retard roller and the nip force with which the retard roller holds the sheet down, but larger than the product of the coefficient of friction between two sheets being fed and the nip force with which the retard roller holds the sheets down. The turning force of the driving motor is transferred directly to the retard roller, but may be transferred through either a reducing gear train or a torque limiter, or both.

According to another embodiment of the present invention, a paper feeder has a feed roller for feeding a sheet in one direction positioned on the downstream side of a pickup roller for taking out the uppermost one of sheets stored in a sheet-feeding cassette, an arm urged toward the feed roller is rockably supported, a retard motor shaft and a retard roller shaft are rotatably supported by the arm, a retard roller which is rotated in the opposite direction to the feed direction of the sheet by a retard motor is provided on the retard roller shaft, and an engaging member is provided on either a plate secured to the retard motor or a fixed member, which is in engagement with the other. The retard motor shaft and the retard roller shaft may be the same.

Further, an elongate slot extending in the radial direction of the retard motor may be formed in the plate and in the fixed member individually; in this case, the engaging member is shiftably fitted in the two elongate slots, whose position relative to either elongate slot can be adjusted.

The retard motor shaft for applying a turning torque to the retard roller is driven so as to rotate the retard roller in the opposite direction to the feed direction of the sheet. Since a control force is acting on the retard roller shaft at this time, the housing of the retard motor receives a turning force acting in the opposite direction to the direction of rotation of the shaft. Although this turning force transfers to the plate, the rotation of the plate is prevented by the engaging member; thus, the plate receives an angular moment whose fulcrum corresponds to the engaging member, whereby the retard roller is urged toward the feed roller. Such urging force varies depending on the load acting on the retard roller; thus, always one sheet only is fed. By shifting and adjusting the engaging member, the urging force can be readjusted to a desired level at any time.

BRIEF DESCRIPTION OF THE DRAWINGS

FIGS. 1-5 show a first embodiment of the present invention, in which:

FIG. 1 is a sectional view of a portion of a paper feeder;

FIG. 2 is a sectional view taken along line 2—2 in FIG. 1;

FIG. 3 is a sectional view similar to FIG. 1 but showing the operation during paper feeding;

FIG. 4 is a diagram explanatory of the turning torque of a retard roller when one sheet is taken out;

FIG. 5 is a diagram explanatory of the turning torque of the retard roller when two sheets are taken out;

FIGS. 6 and 7 show a second embodiment of the present invention, in which:

FIG. 6 is a sectional view of a portion of a paper feeder;

FIG. 7 is a sectional view taken along line 7—7 in FIG. 6;

DESCRIPTION OF THE PREFERRED EMBODIMENTS

Figure 1:
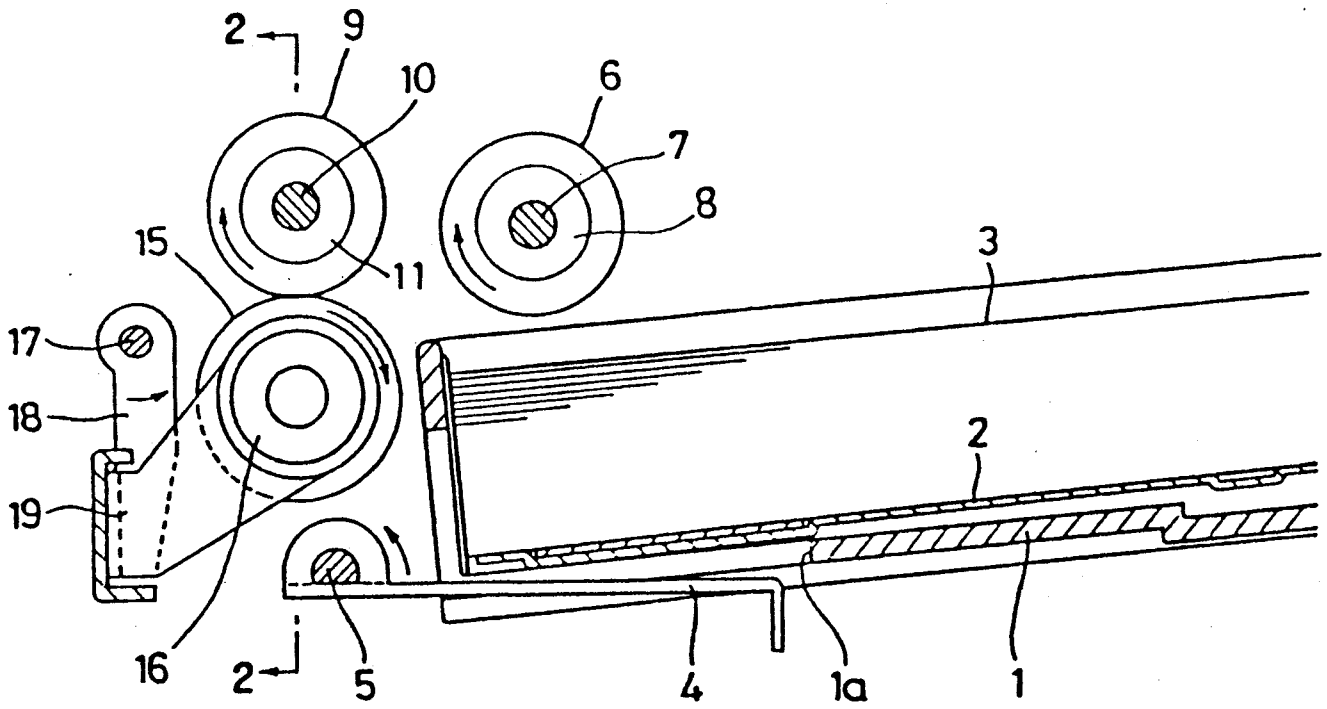

As shown in FIG. 1, a bottom plate 2 is provided at the bottom of a sheet-feeding cassette 1 whose left distal-end portion is vertically rockable with its non-illustrated right end portion acting as a rocking center. Sheets 3 are stored and piled on the bottom plate 2. An opening 1*a* is formed below the left distal-end portion of the bottom plate 2, through which a fluctuating lever 4 for lifting the bottom plate 2 can pass. The fluctuating lever 4 is connected to a shaft 5 so that when the shaft 5 rotates in response to a paper feed instruction, the fluctuating lever 4 is rocked about the shaft 5.

A pickup roller 6 is provided above a left distal-end portion of the sheet-feeding cassette 1. The pickup roller 6 is connected via a one-way clutch 8 to a shaft 7 which is rotated in response to the paper feed instruction so that the pickup roller 6 can rotate clockwise or in one direction.

Figure 2:
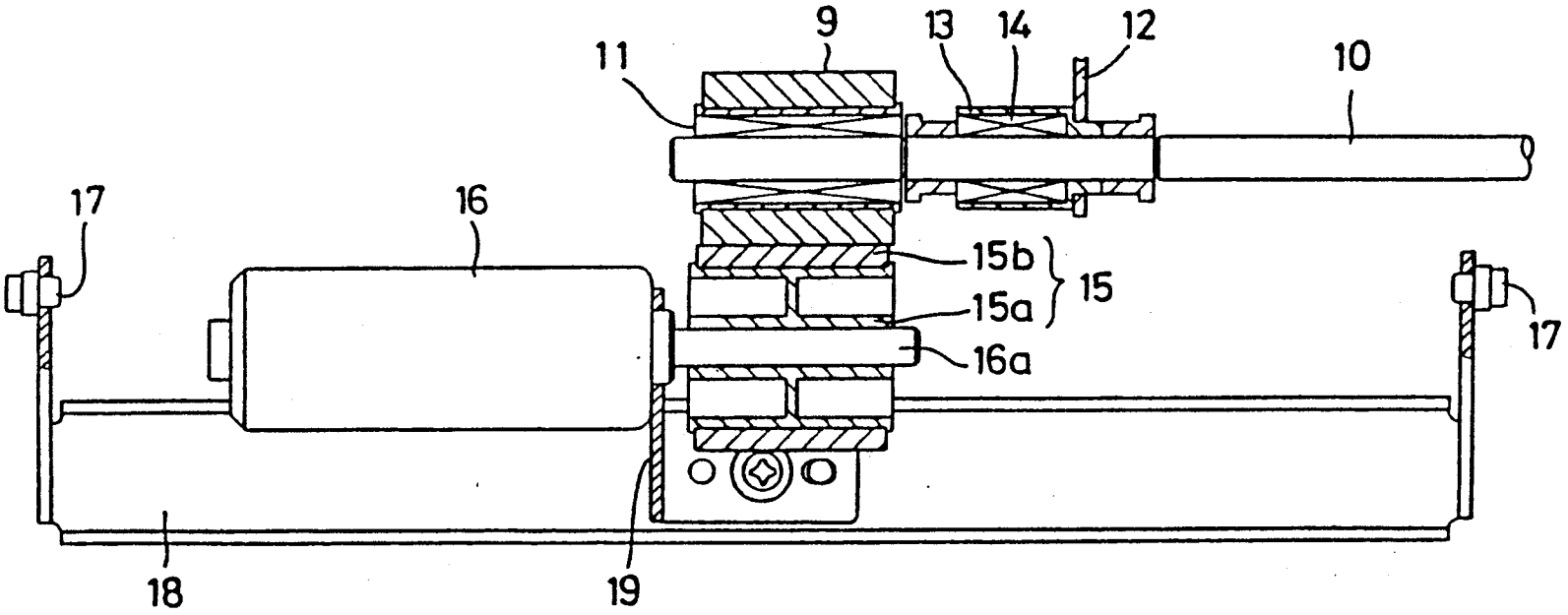

A feed roller 9 is provided on the downstream side of the pickup roller 6. The feed roller 9 is connected via a one-way clutch 11 to a shaft 10 which is driven by means of a non-illustrated electromagnetic clutch operable in an on-off mode so that the feed roller 9 can rotate clockwise or in one direction. As shown in FIG. 2, the shaft 10 is supported via a one-way clutch 14 by a member 13 secured to a support plate 12, so that the shaft 10 can rotate clockwise in FIG. 1 or in one direction. A non-illustrated resist roller for conveying the sheet fed forward from the feed roller 9 to a printing position is provided on the downstream side of the feed roller 9.

A retard roller 15 is held in resilient contact with a peripheral lower portion of the feed roller 9. As shown in FIG. 2, the retard roller 15 is composed of a central turning member 15*a* and an elastic member 15*b* fitted thereon, the turning member 15*a* being secured to a shaft 16*a* of a driving motor 16. Means for supporting the retard roller 15 and the driving motor 16 will be described. As shown in FIG. 2, an arm 18 is rockably supported by pivot shafts 17 and 17, and a retard plate 19 is provided integrally with the arm 18. The driving motor 16 is secured to the retard plate 19, the shaft 16*a* of the driving motor 16 projects through the retard plate 19, and the turning member 15*a* of the retard roller 15 is secured to the projection end of the shaft 16*a*. A non-illustrated spring is connected to the arm 18 so that the arm 18 is urged by a counterclockwise (in FIG. 1) turning force about the pivot shaft 17. As a result, the retard roller 15 is held in resilient contact with the feed roller 9. The retard roller 15 has applied a turning torque acting in the opposite direction to the direction of rotation of the feed roller 9 (in the clockwise direction in FIG. 1) by the driving motor 16. A drive circuit of the driving motor 16 includes a non-illustrated current-limiting circuit or the like so that the torque generated is maintained constant. The turning torque from the driving motor 16 will be described later in greater detail.

Figure 3:
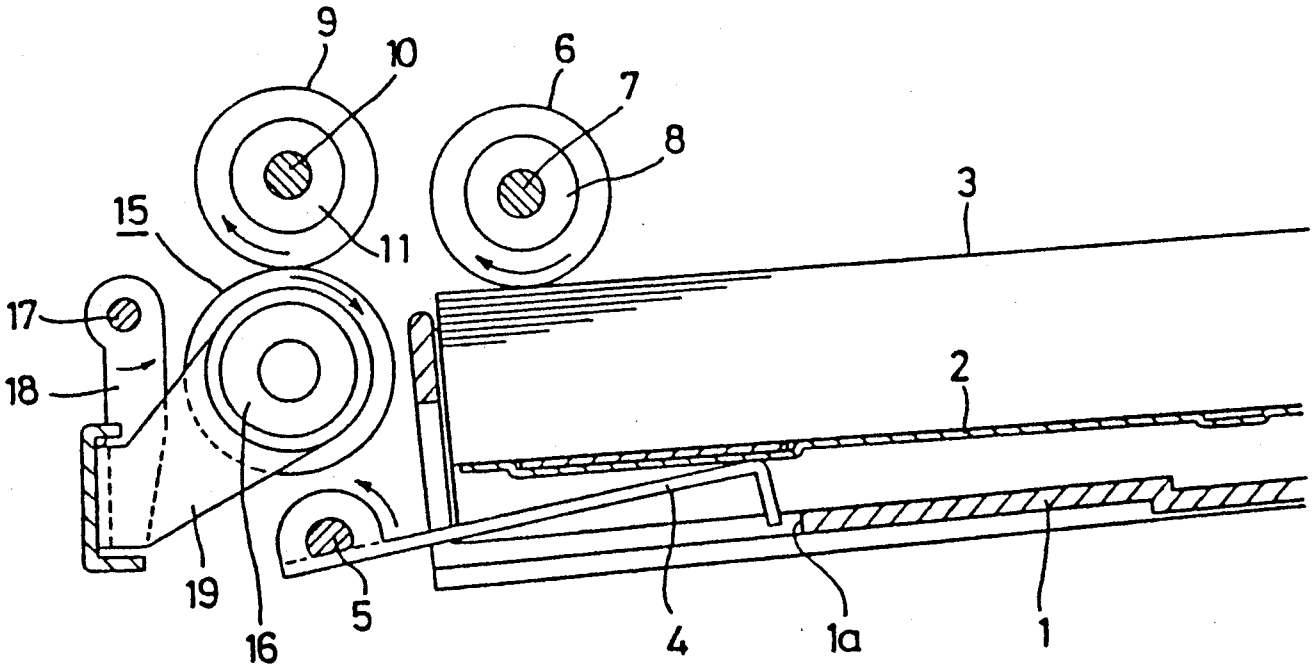

According to the foregoing structure, when the shaft 5 rotates counterclockwise in FIG. 3 in response to paper feed instructions, the fluctuating lever 4 passes through the opening 1*a* into the sheet-feeding cassette 1 as shown in FIG. 3 to lift up the distal-end portion of the bottom plate 2, so that the sheets 3 are pressed against the pickup roller 6. Since the pickup roller 6 is rotated clockwise in response to the paper feed instructions as described above, the uppermost sheet 3 is moved out leftwardly by the frictional force between it and the pickup roller 6 and fed between the feed roller 9 and the retard roller 15.

Figure 4:
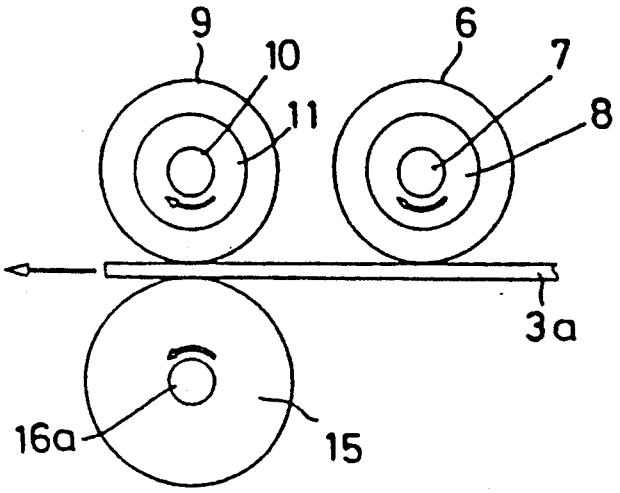

The turning torque exerted by the feed roller 9 and the retard roller 15 on the sheet pinched between them will be described. First, the case where only one sheet 3*a* is taken out as shown in FIG. 4 will be considered. To cause the sheet 3*a* to be conveyed leftwardly in compliance with the clockwise rotation of the feed roller 9, the following must hold:

$$\mu_{PR}N > RT \quad (1)$$

where $\mu_{PR}$ is the coefficient of friction between the sheet 3*a* and the retard roller 15, N is the nip force with which the retard roller 15 holds the sheet 3*a* down, R is the radius of the retard roller 15, and T is the predetermined torque of the driving motor 16. If the torque T of the driving motor 16 is set so as to meet the foregoing condition, one sheet 3*a* will be conveyed leftwardly by the rotation of the feed roller 9. That is, owing to the frictional force $\mu_{PR}N$ from the sheet 3*a*, the retard roller 15 is rotated counterclockwise in opposition to the driving force RT from the driving motor 16.

Figure 5:
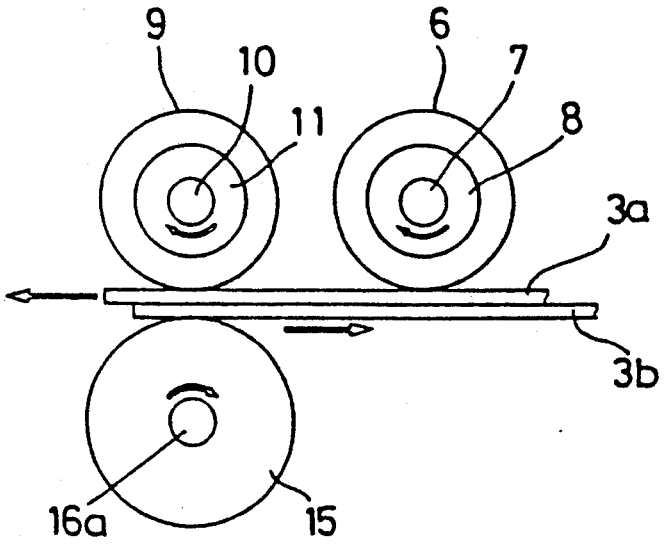

Since the sheets 3 in the sheet-feeding cassette 1 are kept in a tightly piled state, there exists the possibility of two sheets being taken out simultaneously by the pickup roller 6. The case where two sheets 3*a* and 3*b* are taken out as shown in FIG. 5 will now be considered. Since the upper sheet 3*a* of two sheets is conveyed leftwardly in compliance with the clockwise rotation of the feed roller 9 whereas the lower one 3*b* is returned rightwardly in compliance with the rotation of the retard roller 15, the following must hold:

$$RT > \mu_{PP}N \quad (2)$$

where $\mu_{PP}$ is the coefficient of friction between the sheet 3*a* and the sheet 3*b*. If the torque T of the driving motor 16 is set so as to meet condition (1) and condition (2), the upper one of the two sheets will be conveyed leftwardly by the rotation of the feed roller 9, and at the same time, the lower sheet will be returned rightwardly by the clockwise rotation of the retard roller 15 caused by the driving force from the driving motor 16, such that one sheet only will always be conveyed by the feed roller 9.

To prevent the sheet 3*a* from bending or becoming arcuate between the feed roller 9 and the pickup roller 6 when being moved by the feed roller 9, the rotational speed of the feed roller 9 is set to be larger than that of the pickup roller 6. This tends to cause the pickup roller 6 to rotate faster in compliance with the feed roller 9 by the aid of the sheet 3*a* and to apply a load to the pickup roller. However, such a problem can be solved by providing a one-way clutch 8 in the pickup roller 6. When the sheet 3*a* conveyed beyond the feed roller 9 is pinched by the non-illustrated resist roller as described above, a non-illustrated electromagnetic clutch for rotating the feed roller 9 is turned off to idle the shaft 10. The rotational speed of the resist roller is set larger than that of the feed roller 9. Therefore, the feed roller 9 also tends to rotate faster in compliance with the resist roller by the aid of the sheet 3*a* and to apply a load to the feed roller 9. However, such a problem can be solved by providing one-way clutches 11 and 13 as in the above case. When the sheet 3*a* has passed between the feed roller 9 and the retard roller 15, the feed roller 9 comes into resilient contact with the retard roller 15, thus tending to cause the feed roller 9 to rotate counterclockwise as it receives the turning torque from the retard roller 15. However, the feed roller 9 can never rotate counterclockwise because its direction of rotation is restricted to one direction by the one-way clutch 11.

Figure 6:
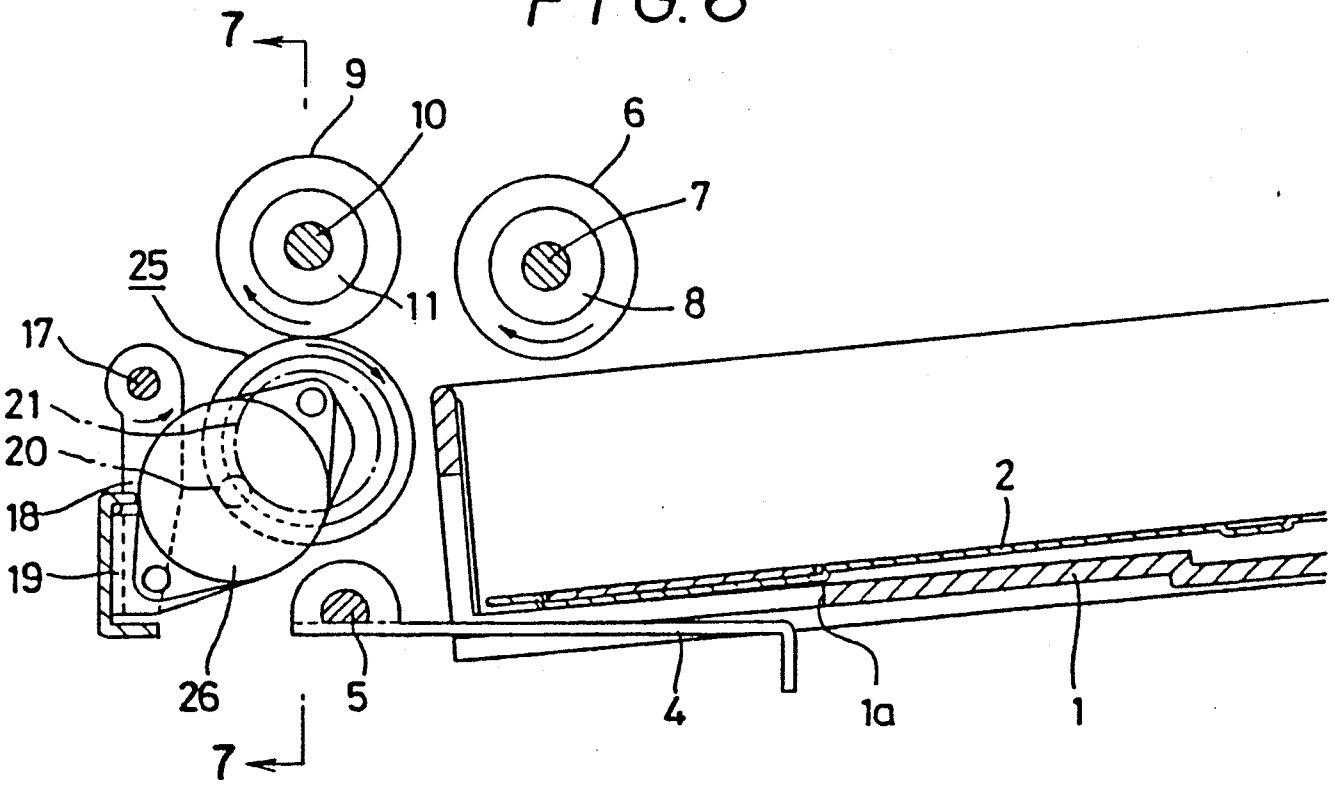
Figure 7:
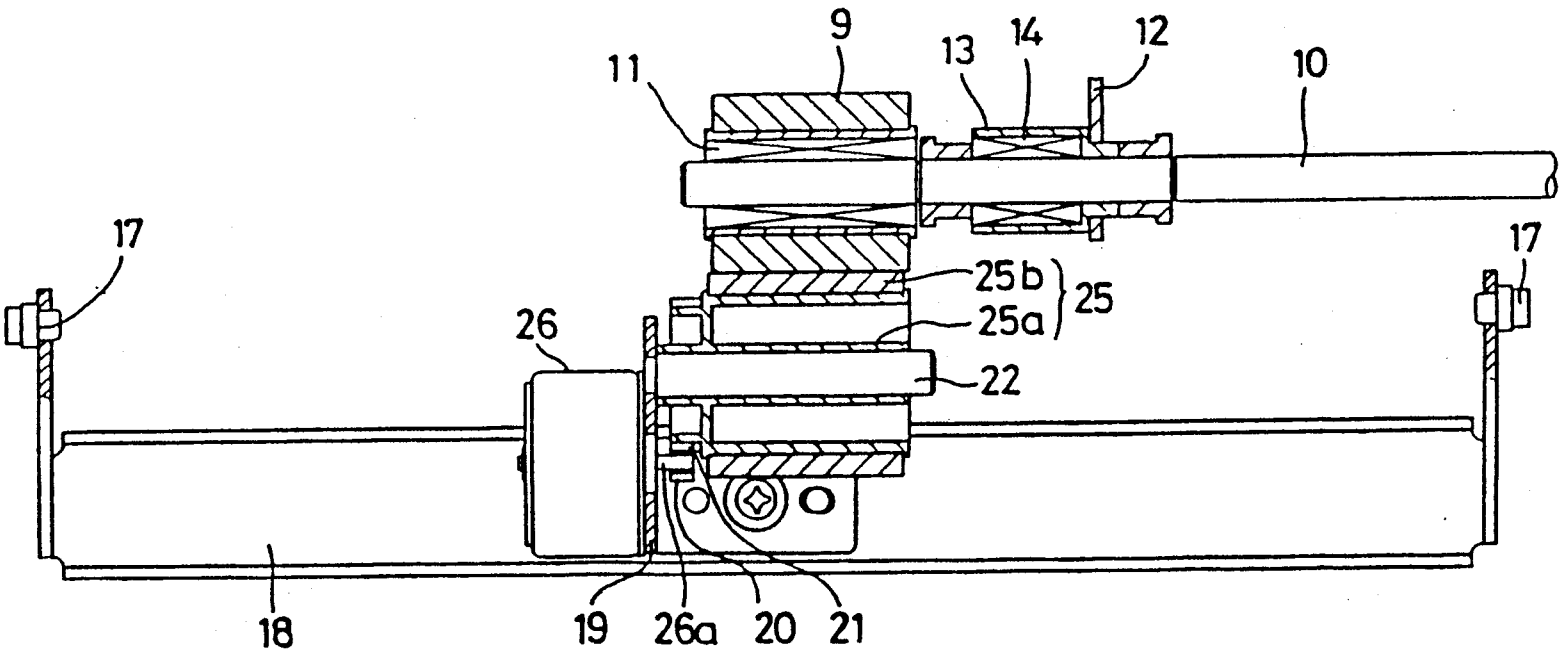

FIGS. 6 and 7 show a second embodiment. Although in the first embodiment described above the retard roller 15 is directly connected to the shaft 16*a* of the driving motor 16 so that the turning force of the driving motor 16 is directly transferred to the retard roller 15, in the second embodiment, a retard roller 25 is rotatably supported by a shaft 22 mounted on the retard plate 19. On the other hand, a driving gear 20 is secured to a shaft 26*a* of a driving motor 26. A transfer gear 21 is integrally provided on a central turning member 25*a* of the retard roller 25, and the turning member 25*a* has an elastic member 25*b* fitted thereon as is the case in the first embodiment. A reducing gear train is composed of the driving gear 20 and the transfer gear 21, so that the turning force of the driving motor 26 is transferred through the reducing gear train to the retard roller 25. The other structure is virtually identical with that of the first embodiment; thus, the same reference numeral is used. In this way, by interposing the gears 20 and 21, the rotational speed characteristic of the driving motor 26 is changed to meet a given rotational speed and the like required by the retard roller 25, whereby the conditions (1) and (2) described above can be readily held.

Figure 8:
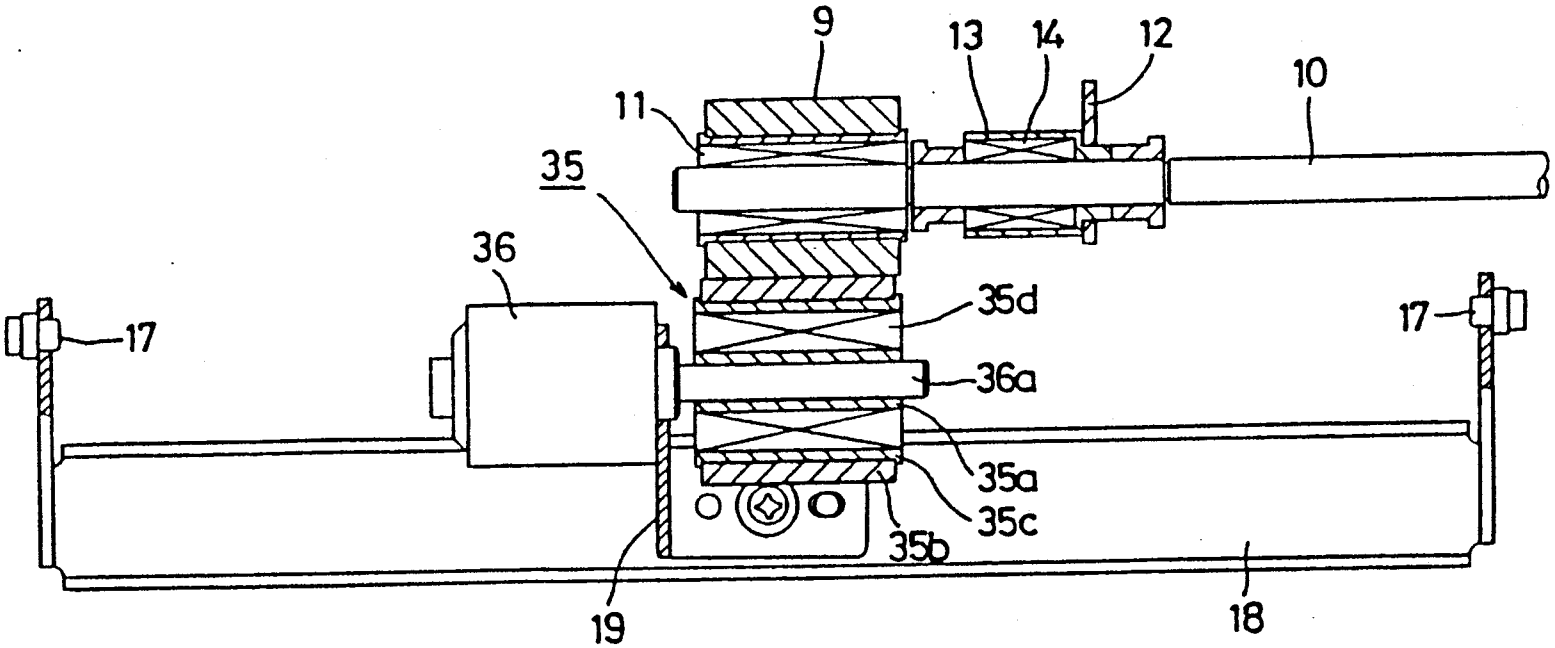
FIGS. 8 and 9 are sectional views showing a third and a fourth embodiment, respectively, of the present invention.

FIG. 8 shows a third embodiment. A torque limiter 35*d* is provided between a sleeve 35*a* secured to a shaft 36*a* of a driving motor 36 and a sleeve 35*c* secured to the inner surface of an elastic member 35*b* of a retard roller 35. In this way, by mounting the retard roller 35 on the shaft 36*a* via the torque limiter 35*d*, the conditions (1) and (2) described above or $$\mu_{PR}N > RT > \mu_{PP}N$$

can be readily held.

Figure 9:
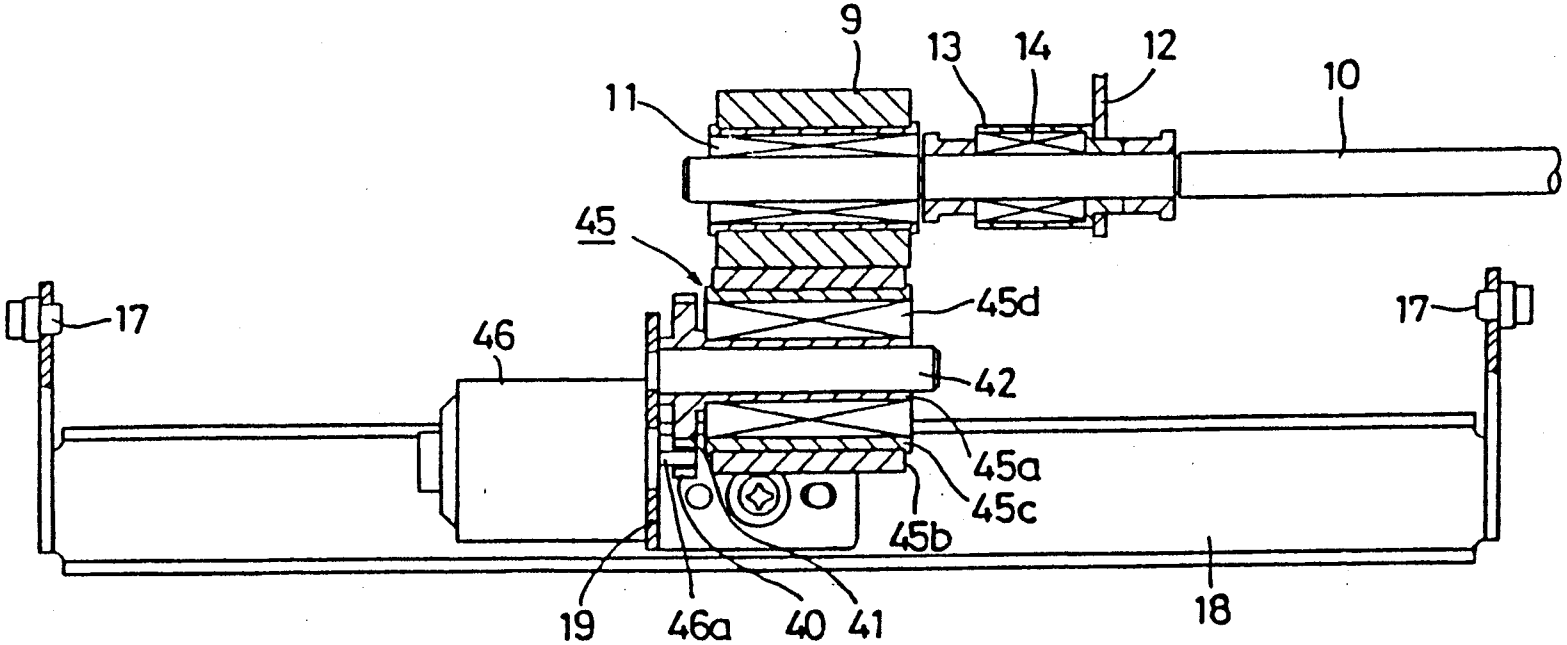

FIG. 9 shows a fourth embodiment which includes the provisions of the second embodiment and the third embodiment described above. That is, a driving gear 40 is secured to a shaft 46*a* of a driving motor 46, and a transfer gear 41 in gear with the driving gear 40 is rotatably supported by a shaft 42 mounted on the retard plate 19. A torque limiter 45*d* is provided between a sleeve 45*a* integral with the transfer gear 41 and a sleeve 45*c* secured to the inner surface of an elastic member 45*b* of a retard roller 45. In this way, the turning force of the driving motor 46 is transferred through a reducing gear train composed of the driving gear 40 and the transfer gear 41 to the shaft 42 and further through the torque limiter 45*d* to the retard roller 45. The other structure is virtually identical with that of the first embodiment; thus, the same reference numeral is used. By interposing the gears 40 and 41, the rotational speed and like characteristics of the driving motor 46 can be readily changed to meet a given rotational speed and the like required by the retard roller 45, and by providing the torque limiter 45*d*, the conditional expressions (1) and (2) described above can be readily held.

The paper feeder of the foregoing structure according to the present invention can readily convey one sheet at a time, the number of parts is decreased, the structure is simplified, and the cost can be cut down. Further, the retard roller can be readily rotated with a given turning torque and at a given rotational speed.

Further embodiments of the present invention will now be described with reference to the FIGS. 10–17 of the drawings.

Figure 10:
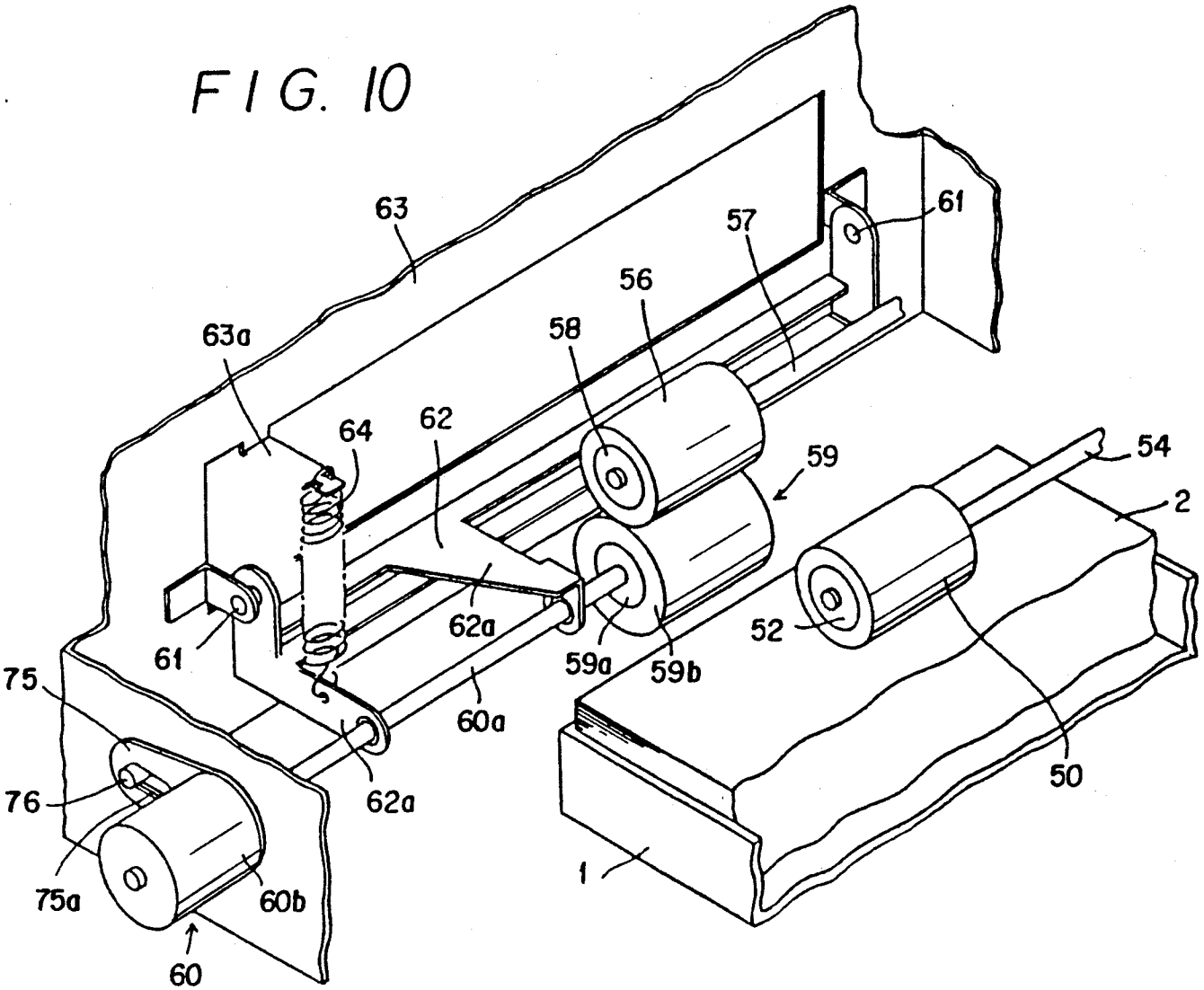
FIG. 10 is a fragmentary perspective view of a paper feeder of a fifth embodiment.

As shown in FIG. 10, sheets 2 are stored in a sheet-feeding cassette 1 in a piled state. A fluctuating lever which moves vertically in response to a paper feed instruction is provided at the bottom of the sheet-feeding cassette 1; thus, the sheets 2 are lifted by the fluctuating lever.

A pickup roller 50 is provided above a left distal-end portion of the sheet-feeding cassette 1. The pickup roller 50 is connected via a one-way clutch 52 to a shaft 54 which is rotated in response to the paper feed instruction, so that the pickup roller 50 can rotate clockwise (see FIG. 14) or in one direction.

A feed roller 56 is provided on the downstream side of the pickup roller 50 (in a left portion of FIG. 10). The feed roller 56 is connected via a one-way clutch 58 to a shaft 57 which is driven by means of a non-illustrated electromagnetic clutch in on-off mode, so that the feed roller 56 can rotate clockwise or in one direction as is the case in the pickup roller 50.

A non-illustrated resist roller for conveying the sheet 2 fed forward from the feed roller 56 to a printing position is positioned on the downstream side of the feed roller 56.

A retard roller 59 is held in resilient contact with a peripheral lower portion of the feed roller 56. As shown in FIG. 10, the retard roller 59 is composed of a central torque limiter 59*a* and an elastic member (e.g., rubber) 59*b* fitted thereon, the retard roller 59 being mounted via the torque limiter 59*a* on a shaft 60*a* of a retard motor 60.

Means for supporting the retard roller 59 and the retard motor 60 will be described.

As shown in FIG. 10, an arm 62 is rockably supported via pivot shafts 61 and 61 by a fixed member or support plate 63. The arm 62 is formed integrally with bending portions 62*a* and 62*a* by which the shaft 60*a* of the retard motor 60 is rotatably supported. The shaft 60*a* is prevented from axially shifting by an E-ring or the like not shown.

As shown in FIG. 10, a spring 64 is stretched between the bending portion 62*a* of the arm 62 and a hook 63*a* formed by bending a portion of the support plate 63, so that the arm 62 is urged by a counterclockwise (see FIG. 14) turning force about the pivot shaft 61. Thus, the retard roller 59 is held in resilient contact with the feed roller 56.

The retard roller 59 is applied with a turning torque acting in the opposite direction to the feed direction of the sheet 2 (in the clockwise direction in FIG. 14) by the retard motor 60 via the torque limiter 59*a*.

Figure 11:
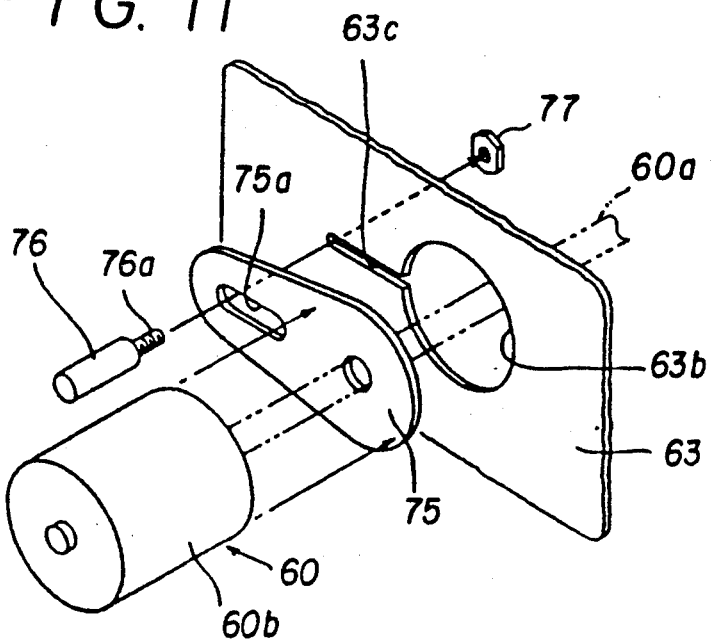
FIG. 11 is an exploded perspective view of a portion of the fifth embodiment.
Figure 12:
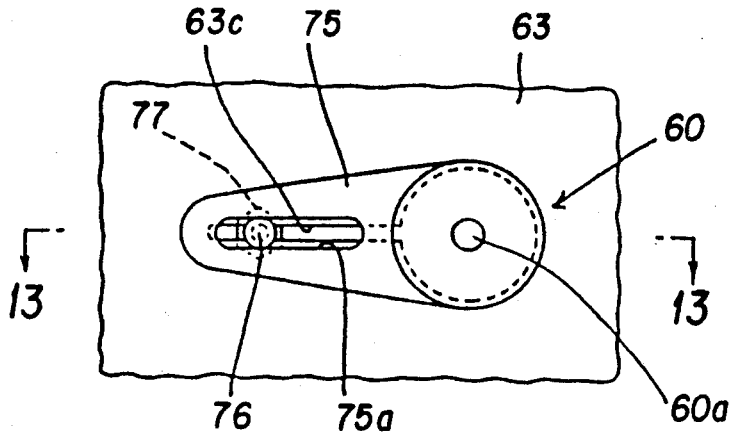
FIG. 12 is a front view corresponding to FIG. 11.
Figure 13:
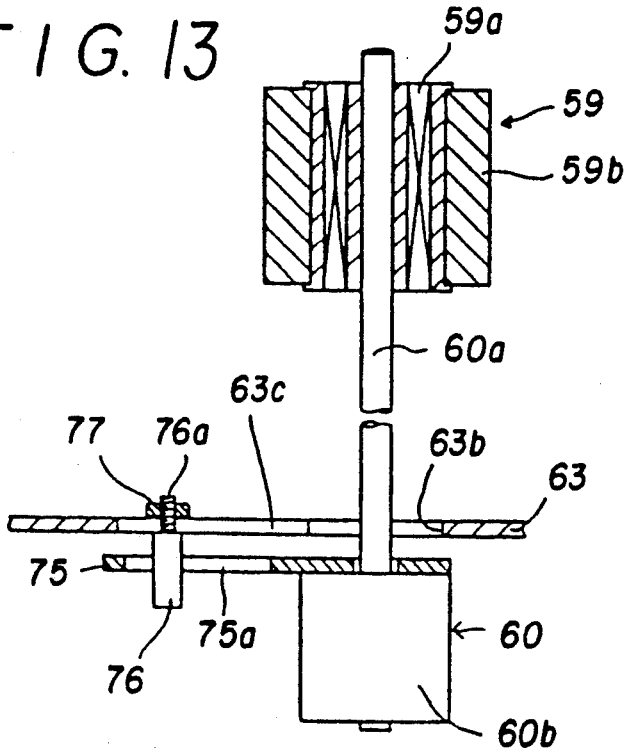
FIG. 13 is a sectional view taken along line 13—13 in FIG. 12.

As shown in FIGS. 11, 12 and 13, a plate 75 is secured to the retard motor 60, and the shaft 60*a* of the retard motor 60 passes through the plate 75 and an opening 63*b* of the casing 63.

The plate 75 and the support plate 63 have elongate slots 75*a* and 63*c*, respectively, extending in the radial direction of the retard motor 60. The width of the elongate slot 75*a* of the plate 75 is larger than that of the elongate slot 63*c* of the casing 63.

An engaging member or pin 76 is fixed to the elongate slot 63*c* of the casing 63 by a nut 77. A screw portion 76a of the pin 76 is small in diameter, so that by loosening the nut 77, the pin 76 can be shifted along the elongate slot 63c for adjustment. The pin 76 fixed to the support plate 63 projects through the elongate slot 75a of the plate 75. Thus, the plate 75 is prevented from rotating about the shaft 60a by the pin 76, and the plate 75 receives an angular moment whose fulcrum corresponds to the pin 76.

According to the foregoing structure, in response to the paper feed instruction, the fluctuating lever lifts up the bottom surface of the sheet-feeding cassette 1 to press the sheet 2 against the pickup roller 50. The pickup roller 50 is rotated clockwise, and the uppermost sheet 2 is taken out leftwardly by means of a frictional force between it and the pickup roller 50 and fed between the feed roller 56 and the retard roller 59.

Therefore, the turning torque exerted by the feed roller 56 and the retard roller 59 is applied to the sheet 2 pinched between them.

The turning torque will now be described.

First, the case where only one sheet 2 is taken out will be considered. To convey the sheet 2 leftward in compliance with the clockwise rotation of the feed roller 56, the following must hold:

$$\mu_\gamma P_B > RT \quad (3)$$

where $\mu_\gamma$ is the coefficient of friction between the sheet 2 and the retard roller 59, $P_B$ is the nip force (hereinafter referred to as "retard roller pressure") with which the retard roller 59 holds the sheet 2 down, R is the radius of the retard roller, and T is the torque of the torque limiter.

If the retard roller pressure $P_B$ and the torque T of the torque limiter are set so as to meet the foregoing condition, one sheet 2 will be conveyed leftward by the rotation of the feed roller 56. That is, due to the frictional force $\mu_\gamma P_B$ from the sheet 2, the retard roller 59 is rotated counterclockwise in opposition to the driving force RT of the retard motor 10.

Two of the sheets stored in the sheet-feeding cassette 1 are sometimes taken out simultaneously by the pickup roller 50. Thus, the case where two sheets are taken out will be considered. In this case, to convey the upper one of the two sheets leftward in compliance with the clockwise rotation of the feed roller 56 and to back the lower one rightward (toward the sheet-feeding cassette 1) in compliance with the rotation of the retard roller 59, the following must hold:

$$RT > \mu_P P_B \quad (4)$$

where $\mu_P$ is the coefficient of friction between the two sheets. If the retard roller pressure $P_B$ and the torque T of the torque limiter are set so as to meet the conditional expressions (3) (4) described above, the upper one of the two sheets will be conveyed leftward by the rotation of the feed roller 56, and at the same time, the lower one will be returned rightward by the clockwise rotation of the retard roller 59. Therefore, only one sheet will always be conveyed by the feed roller 56.

The retard roller pressure $P_B$ will now be described.

Figure 14:
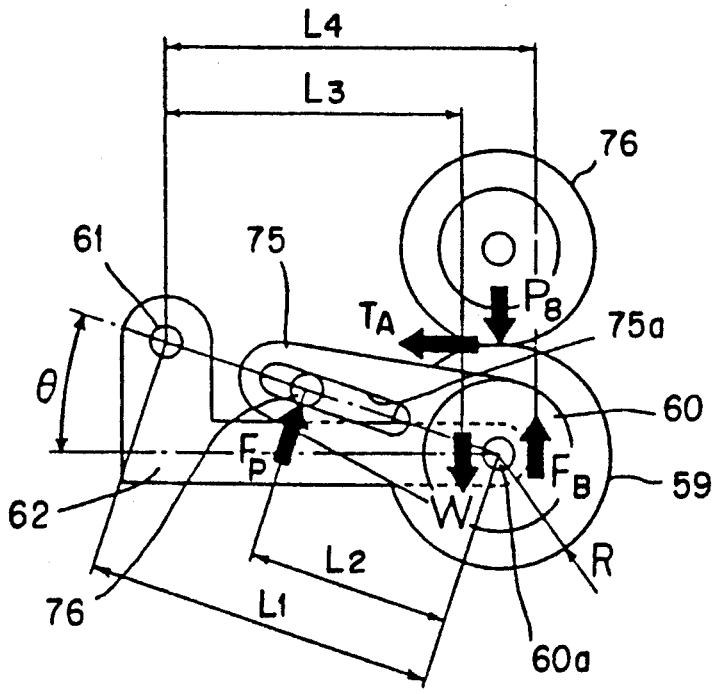
FIG. 14 is a front view showing the directions of forces.

The shaft 60a is driven by the retard motor 60 such that the retard roller 59 is rotated in the opposite direction to the feed direction of the sheet 2 (in the clockwise direction in FIG. 14). Since a braking force is acting on the shaft 60a in this state, a housing 60b of the retard motor 60 receives a turning force acting in the opposite direction to the direction of rotation of the shaft 60a (in the counterclockwise direction in FIG. 14). Although this turning force is transferred to the plate 75, the pin 76 is fitted in the elongate slot 75a, thus preventing the rotation of the plate 75 itself about the shaft 60a; thus, the plate 75 receives an angular moment whose fulcrum corresponds to the pin 76, whereby the retard roller 59 is urged toward the feed roller 56. Such an urging force corresponds to $P_B$ of the conditional expressions (3) and (4) described above.

The relationship between the retard roller pressure $P_B$ and the torque T of the torque limiter will be described with reference to FIG. 14.

Where the clockwise direction is assumed to take a negative sign while considering the balancing of moments about the pivot shaft 61, the following relational expression holds:

$$T_A(R-L_1\sin\theta)+F_P(L_1-L_2)+F_BL_4-P_BL_1\cos\theta-WL_3=0 \quad (5)$$

where $T_A$ is the return force of the torque limiter 59a, $F_P$ is the opposite force which the pin 76 receives from the support plate 63, W is the whole weight of the unit inclusive of the retard roller 59, retard motor 60 and plate 75, $F_B$ is the tensional force of the spring 64, $L_1$ is the center distance between the pivot shaft 61 and the retard roller 59, $L_2$ is the center distance between the pin 76 and the retard roller 59, $L_3$ is the distance between the center of the pivot shaft 61 and the center of gravity at which W acts, $L_4$ is the distance from the center of the pivot shaft 61 to a lock portion of the spring 64, and $\theta$ is the inclination angle made by the horizontal line passing through the center of the shaft 60a and the straight line connecting the centers of the shaft 60a and the pivot shaft 61.

Since the predetermined torque of the torque limiter 9a is T, the following holds:

$$T_AR=T \quad (6)$$

and also the following holds because of the balancing about the plate 75:

$$F_PL_2=T \quad (7)$$

By expressing the retard roller pressure $P_B$ considering the conditional expressions (5), (6) and (7) and using the return force $T_A$ of the torque limiter, the following results:

$$P_B=(F_BL_4-WL_3)/(L_1\cos\theta)+(R/L_2)T_A/\cos\theta \quad (8).$$

If the following are used to arrange the conditional expression (6):

$$(R/L_2-\sin\theta)/\cos\theta=K \quad (81)$$

$$(F_BL_4-WL_3)/(L_1\cos\theta)=P_{BO} \quad (82)$$

the following is obtained:

$$P_B=KT_A+P_{BO} \quad (83)$$

this meaning that there is a proportional relationship between $P_B$ and $T_A$.

Therefore, if the foregoing conditional expressions (3) and (4) are met, there is obtained a zone where the two rollers 56 and 59 can feed only one sheet 2. That is, if the retard roller pressure $P_B$ is set so as to meet the following:

$$(T_A/\mu_P) > P_B > (T_A/\mu_r) \quad (9)$$

one sheet 2 only is fed.

The variable range of each parameter has been obtained experimentally as follows:

$$0.75 \geqq \mu_P \geqq 0.3 \quad (10)$$

$$1.6 \geqq \mu_r \geqq 1.0 \quad (11)$$

$$600 \geqq T_A \geqq 300 \text{ (gf)} \quad (12).$$

Figure 15:
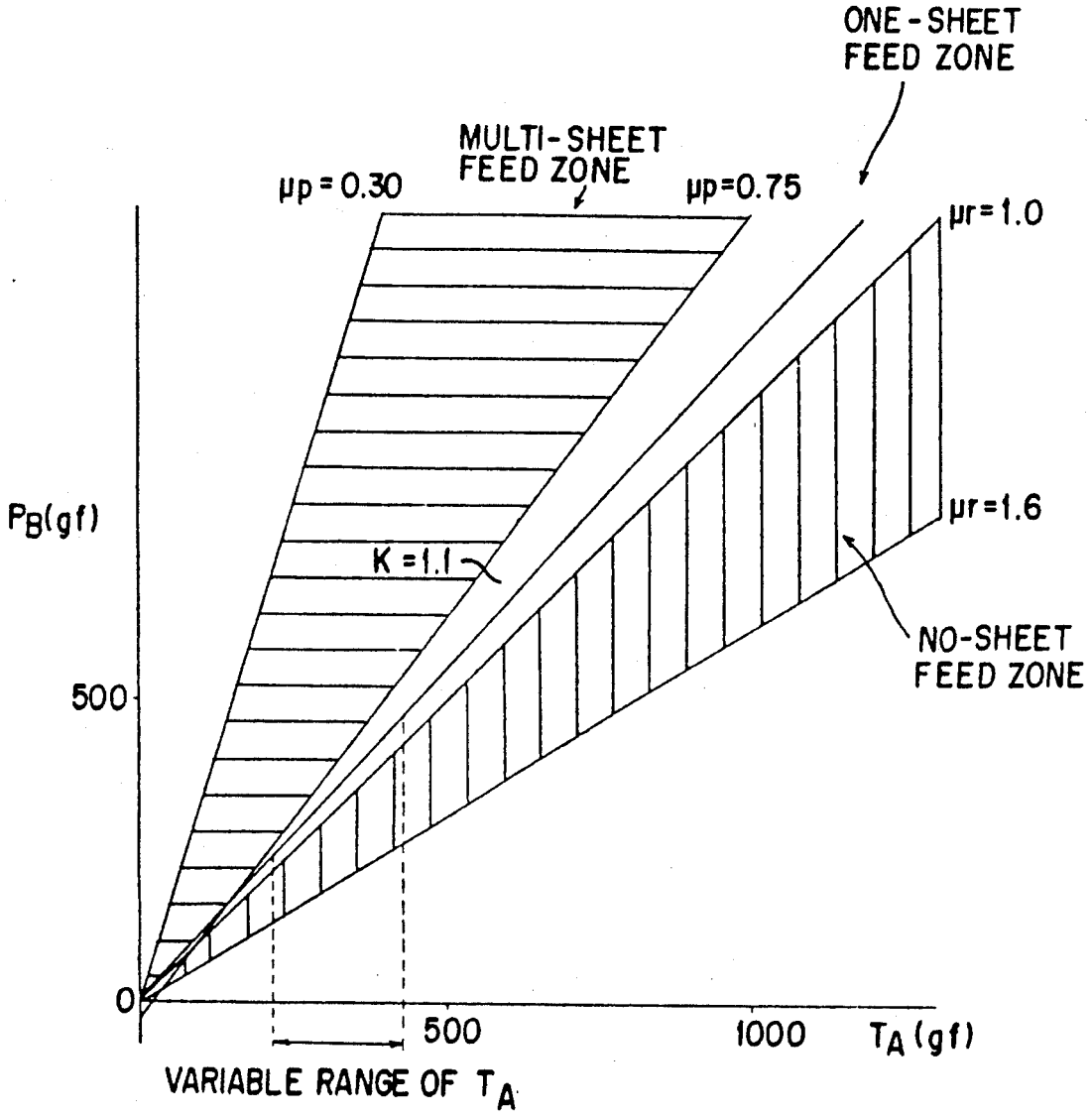
FIG. 15 is a performance chart.

Thus, where the diameter R of the retard roller 59 is, for example, 25(mm), a performance chart as shown in FIG. 15 is obtained. In this performance chart, if it is possible to set the conditional expression (83) so as to pass through a one-sheet feed zone, there is obtained the inclination K of a straight line passing through the center of that zone equal to 1.1, which is a reasonable value. Therefore, it is enough to set the values of R, $\theta$ and $L_2$ so as to result in $K=1.1$ in relation to the conditional expression (81).

The $L_2$ is obtained from the expression (81) as follows:

$$\begin{aligned} L_2 &= R/(K\cos\theta + \sin\theta) \\ &= R/(1.1\cos\theta + \sin\theta) \end{aligned} \quad (84)$$

In the conditional expression (63), it is desirable to set the value of $P_{BO}$ such that the performance line falls within the one-sheet feed zone and within the variable range of $T_A$.

The position of the pin 16 that determines the value of $L_2$ can be adjusted by loosening the nut 77 shown in FIG. 11. In case the radius R of the retard roller 59 changes due to wear, the value of K can be readjusted to an optimum by adjusting the position of the pin 76.

Figure 16:
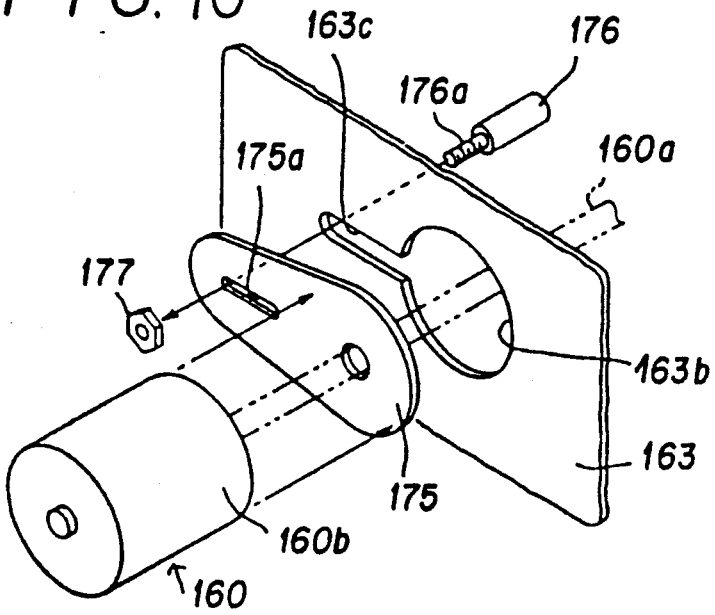
FIG. 16 is an exploded perspective view showing a portion of another embodiment.

FIG. 16 shows another embodiment, in which the opening width of an elongate slot 175*a* of a plate 175 is smaller than that of an elongate slot 163*c* formed in a support plate 163, and an engaging member or pin 176 is fixed to the elongate slot 175*a* of the plate 175 by a nut 177. The structure wherein the plate 175 is prevented from rotating about a shaft 160*a* because the pin 176 fixed to the plate 175 passes through the elongate slot 163*c* of the support plate 163 and the pin 176 can be shifted and adjusted by loosening the nut 177, is virtually identical with that of the embodiment of FIG. 11.

Figure 17:
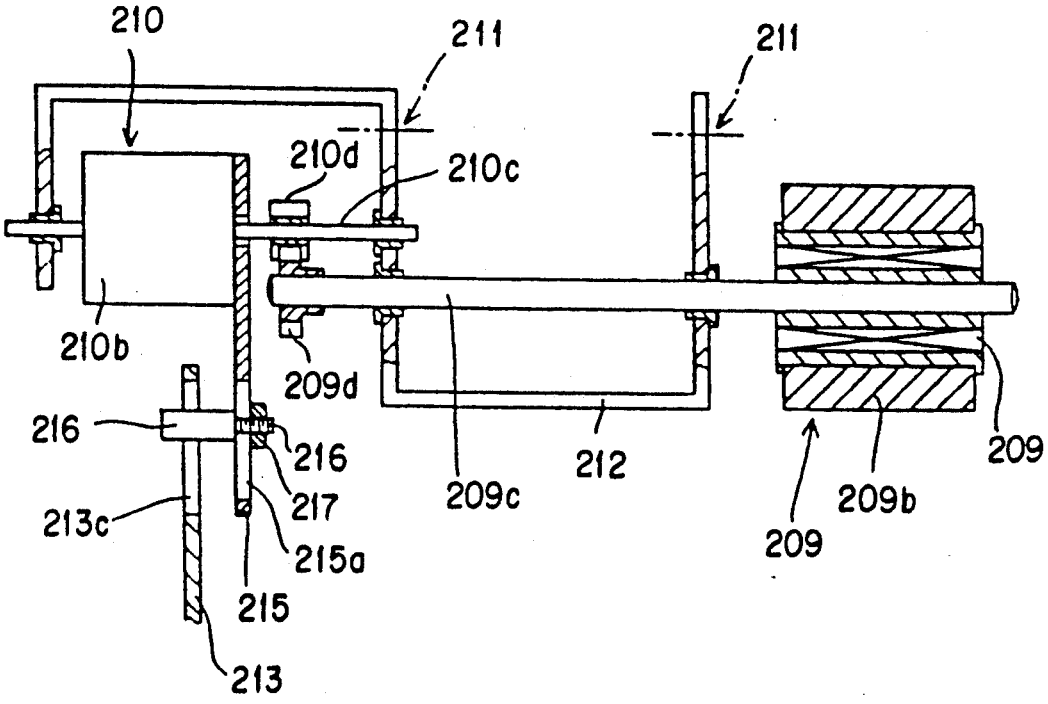
FIG. 17 is a sectional view showing a portion of a further embodiment.

FIG. 17 shows still another embodiment, in which a retard shaft 209*c* of a retard roller 209 is made independent of a motor shaft 210*c* of a retard motor 210. The retard shaft 209*c* and the motor shaft 210*c* are individually rotatably supported by an arm 212, a motor pinion 210*d* secured to the motor shaft 210*c* meshes with a gear 209*d* secured to the retard shaft 209*c*, and the retard roller 209 is rotated in the opposite direction to the feed direction of the sheet 2 by the feed roller. The structure wherein a plate 215 is secured to the retard motor 210 and the rotation of a housing 210*b* of the retard motor 210 is prevented by a support plate 213 and a pin 216 is virtually identical with those of the first and second embodiments. In FIG. 17, with a braking force acting on the retard shaft 209*c*, the housing 210*b* of the retard motor 210 receives a turning force acting in the opposite direction to the direction of rotation of the motor shaft 210*c*. Although this turning force is transferred to the plate 215, the rotation of the plate 215 itself about the motor shaft 210*c* is prevented because the pin 216 is fitted in an elongate slot 213*c*, the plate 215 receives an angular moment whose fulcrum corresponds to the pin 216, and as a result, the retard motor 210 is raised in the upward direction of the sheet face of FIG. 17, and the arm 212 rocks about pivot shafts 211 and 211 in the upward direction of the sheet face of FIG. 17. Accordingly, the retard roller 209 shifts in the upward direction of the sheet face of FIG. 17, and hence, the retard roller 209 is urged toward the non-illustrated feed roller.

Although in the embodiments the engaging member or pin 76 is made shiftable and adjustable, it is also possible to mount the pin 76 on either the plate 75 or the support plate 63 fixedly and form a hole in the other in which the pin 76 can fit.

Although the spring 64 is used as means for bringing the retard roller 59 in resilient contact with the feed roller 56, it is also possible to mount an eccentric weight on the arm 62 by which a counterclockwise turning force about the pivot shaft 61 is applied to the arm.

Although the torque is applied to the retard roller 59 by providing the torque limiter 59*a*, it is also possible to provide a current-limiting circuit or the like in a drive circuit of the retard motor 60 by which the torque generated by the motor itself is maintained constant.

As described above, in the paper feeder according to the present invention, the urging force for urging the retard roller toward the feed roller varies automatically depending on the variation in friction between the sheets, on the friction between the roller and the sheet, and on the torque of the torque limiter; thus, this results in a wide stable zone in which only one sheet will be bed.

Further, since the position of the engaging member is made shiftable and adjustable, the urging force for urging the retard roller can be adjusted to an optimum in compliance with variations, due to wear, in the diameter of the retard roller, in the diameter of the feed roller, etc.

Although the present invention has been described through specific terms, it should be noted here that the described embodiments are not necessarily exclusive and that various changes and modifications may be imparted thereto without departing from the scope of the invention, which is limited solely by the appended claims.

What I claim is:

1. A paper feeder comprising a pickup roller means feeding a paper sheet from a stack of sheets, a rotatable feed roller and a retard roller means biasingly urged toward one another, said rotatable feed roller and said retard roller means being downstream of said pickup roller means, said feed roller means being rotatable in a feed direction for feeding said paper sheet between said feed roller means and said retard roller means, a pivot arm means pivotably supporting said retard roller means on a fixed support structure, said pivot arm means having a first pivot axis, motor means, and mounting means pivotably mounting said motor means on said fixed support structure, said mounting means having a second pivot axis, said mounting means comprising adjusting means for adjusting the position of said second pivot axis relative to said first pivot axis, said motor means being operable to apply a turning torque to said retard roller means in a direction opposite to said direction of feed of said feed roller means.

* * * * *